US007226238B2

(12) United States Patent
Collier

(10) Patent No.: US 7,226,238 B2
(45) Date of Patent: Jun. 5, 2007

(54) AUTOMOBILE WHEEL AND TRACK SNARE

(75) Inventor: Ace R Collier, P.O. Box 590, Bouse, AZ (US) 85325-0590

(73) Assignee: Ace R Collier, Bouse, AZ (US)

( * ) Notice: Subject to any disclaimer, the term of this patent is extended or adjusted under 35 U.S.C. 154(b) by 0 days.

(21) Appl. No.: 10/811,799

(22) Filed: Mar. 29, 2004

(65) Prior Publication Data

US 2005/0214071 A1 Sep. 29, 2005

(51) Int. Cl.
*E01F 13/12* (2006.01)

(52) U.S. Cl. ..... 404/6

(58) Field of Classification Search ..... 404/6, 404/9; 256/1, 13.1
See application file for complete search history.

(56) References Cited

U.S. PATENT DOCUMENTS 4,382,714 A * 5/1983 Hutchison ..... 404/6
4,995,756 A * 2/1991 Kilgrow et al. ..... 404/6
5,498,102 A * 3/1996 Bissell ..... 404/6
5,611,408 A * 3/1997 Abukhader ..... 180/287
5,704,445 A * 1/1998 Jones ..... 180/287
5,890,832 A * 4/1999 Soleau ..... 404/6
5,904,443 A * 5/1999 Soleau ..... 404/6
5,921,704 A * 7/1999 Pacholok et al. ..... 404/6
6,048,128 A * 4/2000 Jones et al. ..... 404/6
6,206,608 B1 * 3/2001 Blevins ..... 404/6
6,224,291 B1 * 5/2001 Mateychuk ..... 404/6

* cited by examiner

*Primary Examiner*—Thomas B. Will
*Assistant Examiner*—Alexandra Pechhold

(57) ABSTRACT

A vehicle disabling and stopping device that will bring a vehicle to a quick stop regardless of the wheel or track configuration. The device comprises an aircraft-type cable or wire rope laced through guide tubes welded onto base plates. The cable ends are fashioned into a running bowline or noose on a deployment board in a configuration intended to choke and hold vehicle tire wheels and control arms. The base plates have two to four tire probes attached thereto to be embedded into the vehicle tires, or in the base of a track driven vehicle, grappling hooks are used. When a vehicle engages the device, the probes lock onto the solid or inflated tire. On a track driven vehicle, the grappling hooks lock onto the track shoe and drive sprocket wheels. The cable ends are fashioned with a running bowline using a double clevis for heavy vehicles. The cable coils around spinning wheels and track, shorting the cable until it chokes the wheel control arms, drive axles, and sprocket wheels.

2 Claims, 8 Drawing Sheets

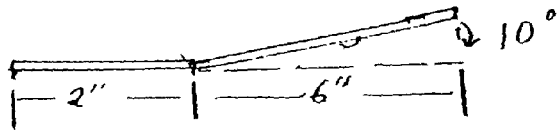
Fig. 1.
Fig. 2.
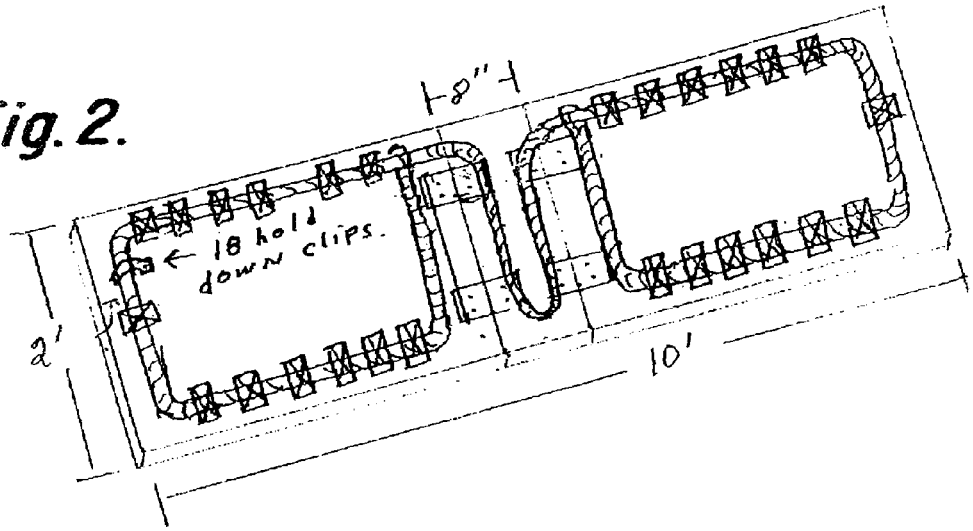

AUTOMOBILE WHEEL AND TRACK SNARE

FIELD OF THE INVENTION

The invention relates to an apparatus to disable vehicles.

BACKGROUND OF THE INVENTION

Every year persons are killed in high-speed motor vehicle chases, such as when police are forced into chasing fleeing suspects. The victims of these high-speed chases include police officers, suspects, members of the public, and members of the military.

DESCRIPTION OF THE PRIOR ART

Various road barriers and tire piercing structure has been utilized in the prior art to prevent vehicles from fleeing the police. An example of a prior art tire piercing apparatus is in U.S. Pat. No. 4,473,948 to Chadwick, where a base plate includes a plurality of pins projecting upwards of the base plate to prevent an automobile from being driven. U.S. Pat. No. 4,382,714 to Hutchison invention is a vehicle-disabling device adapted to project a plurality of spike-like devices to puncture one or more tires of a fleeing vehicle. Such spike-like elements secured to bases by either a strand, cord, or short length of chain are evident in the prior art.

SUMMARY OF THE INVENTION

What is required is a method and apparatus that can be used to halt a suspect's motor vehicle in advance of a police chase, rendering a high-speed chase unnecessary. In its preferred embodiment, the wheel and track snare consists of a folding deployment board, seen in FIG. 2, with a hinge in the middle. The board is about ten feet long and one or two feet wide, though the measurements can be approximated depending on the immediate requirements, since the device can be assembled in a very short time.

BRIEF DESCRIPTION OF THE DRAWINGS

FIG. 1 is a side view of the base plate.

FIG. 2 is a view of the deployment board with hinges for deployment in front of a fleeing vehicle.

DESCRIPTION OF THE PREFERRED EMBODIMENT

Figure 10:
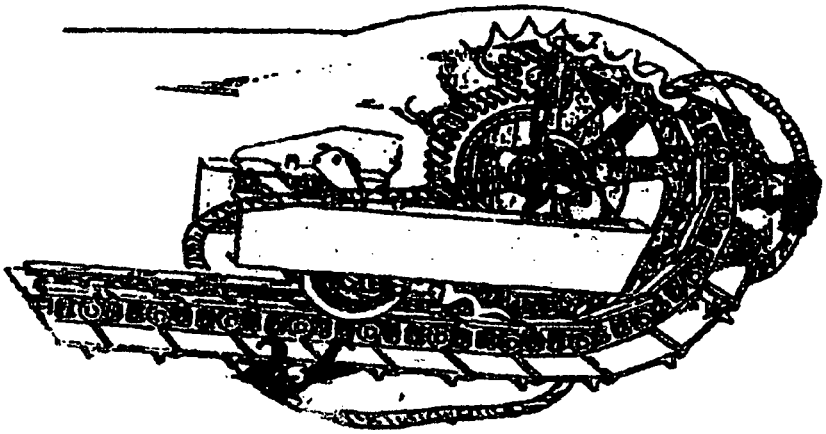
FIG. 10 is a view of another embodiment for use with a tank, showing a snare cable entwined around a track and drive sprocket wheel using grappling hooks to disable the tank.

The wheel and track snare apparatus is designed to quickly and effectively stop a moving vehicle (V) with rubber tires (T). In another embodiment shown in FIG. 10, the snare can be used on a track-driven vehicle (TV), such as a tank. To facilitate disabling of a track-driven vehicle, the base plates (2) are equipped with grapping hooks (6).

Figure 3:
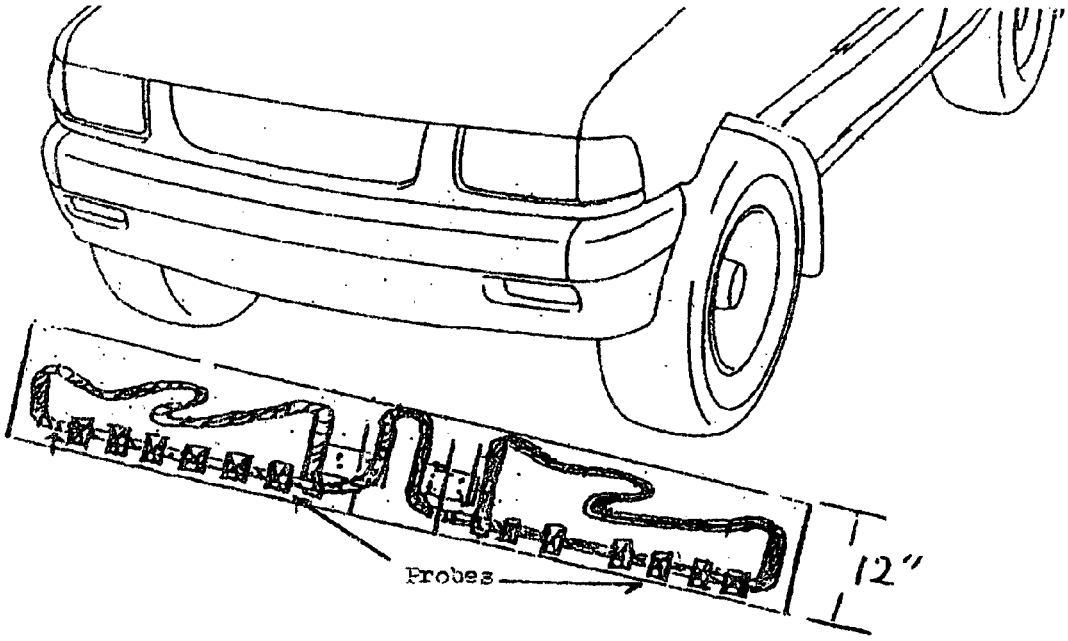
FIG. 3 is a view of a device laid out in front of an approaching vehicle.
Figure 4:
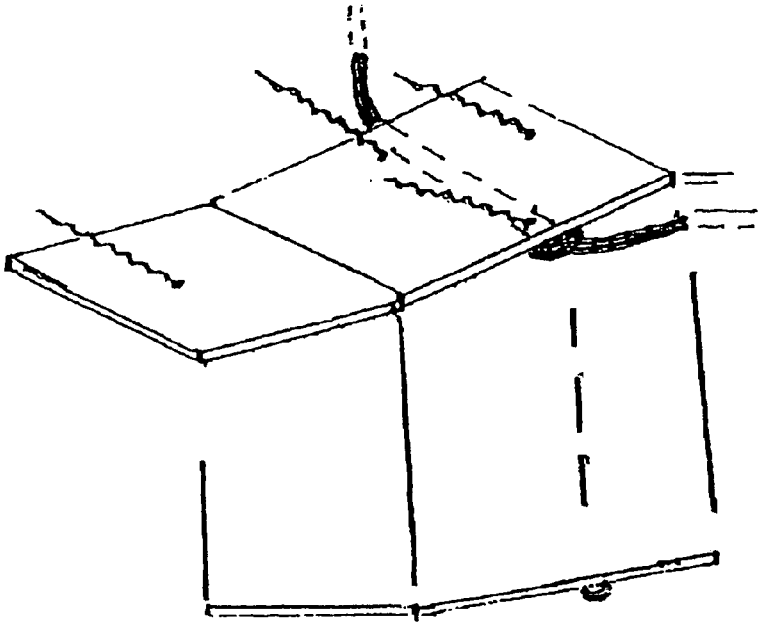
FIG. 4 is an isometric projection of a base plate with a sleeve for the cable, and screw-type barbs projecting from the plate.
Figure 5:
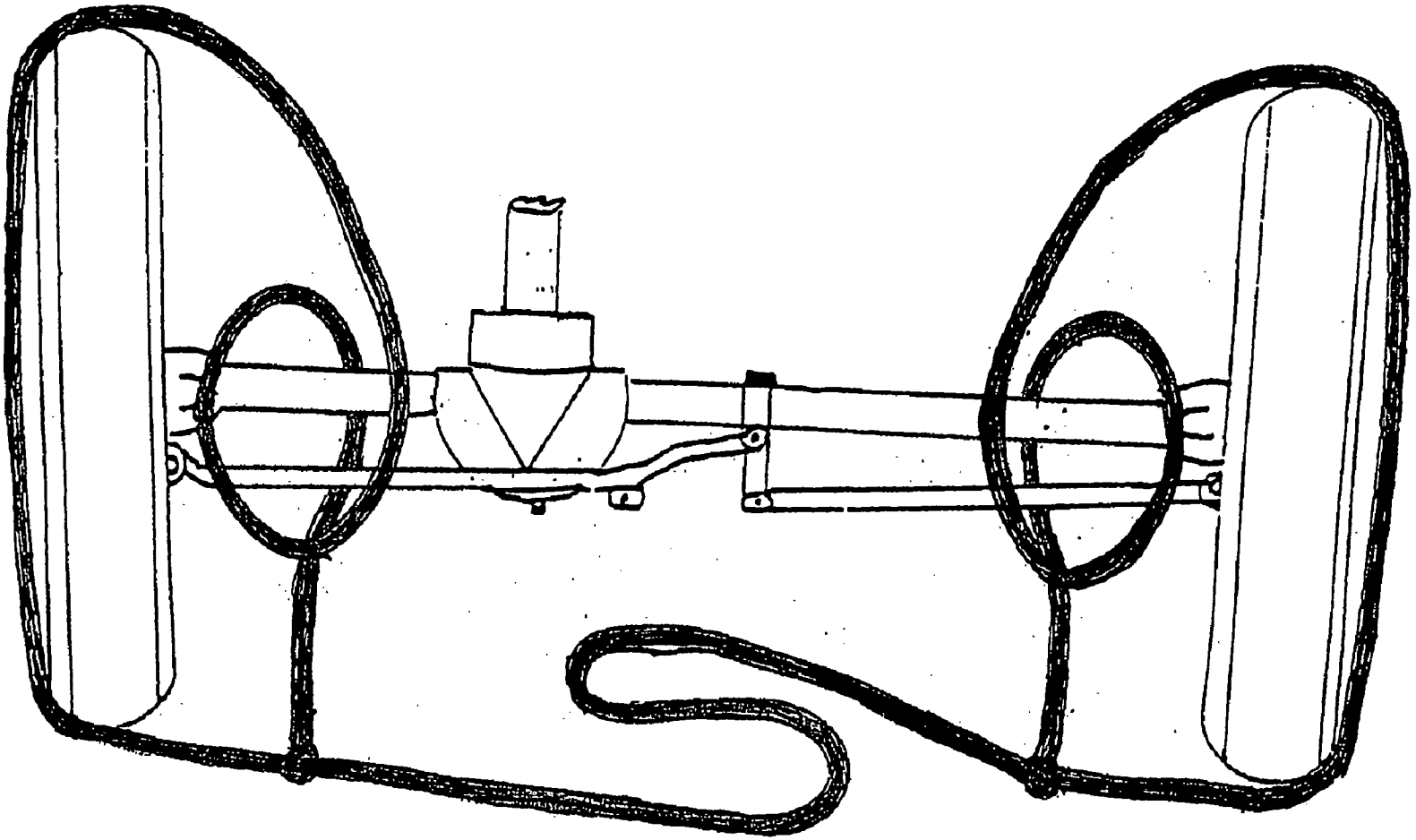
FIG. 5 is a view showing a cable with loops coiling around the wheels' control arms and drive axles.
Figure 6:
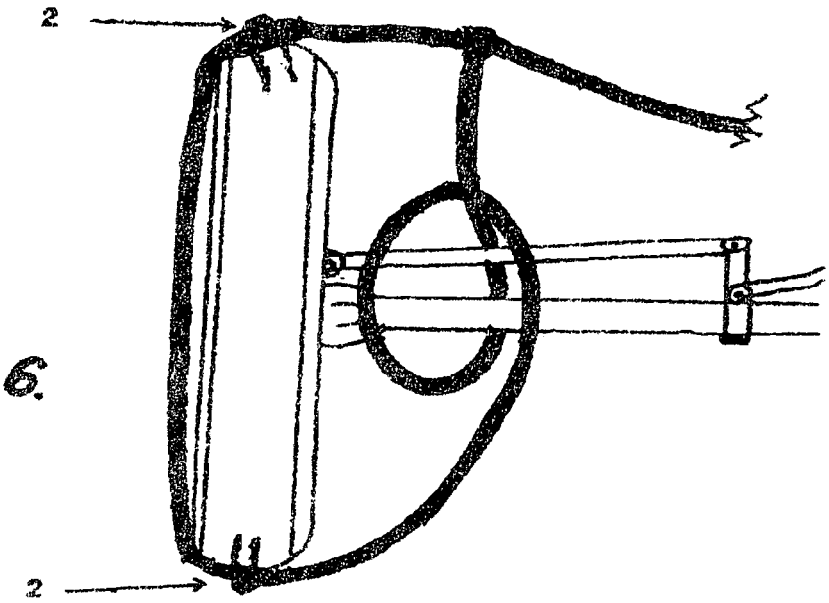
FIG. 6 is a view showing cable snare gripping a wheel of a vehicle.
Figure 7:
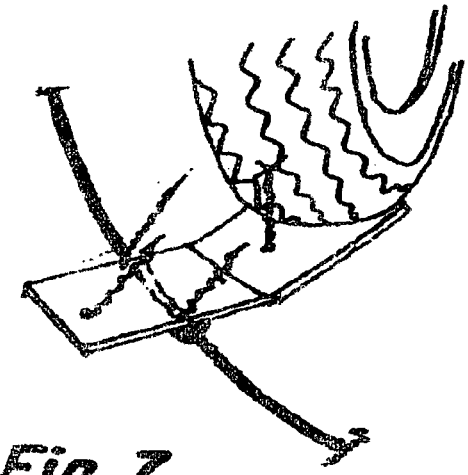
FIG. 7 is a view of a vehicle tire on a spiked base plate to facilitate spike penetration.
Figure 8:
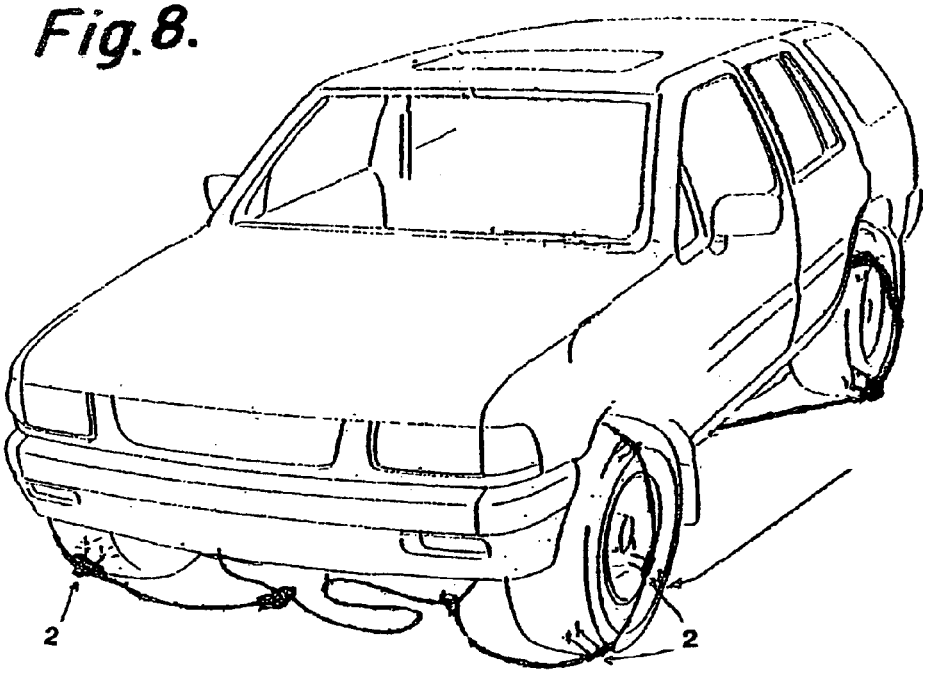
FIG. 8 is a view of the cable snare locking onto the wheels of a vehicle.
Figure 9:
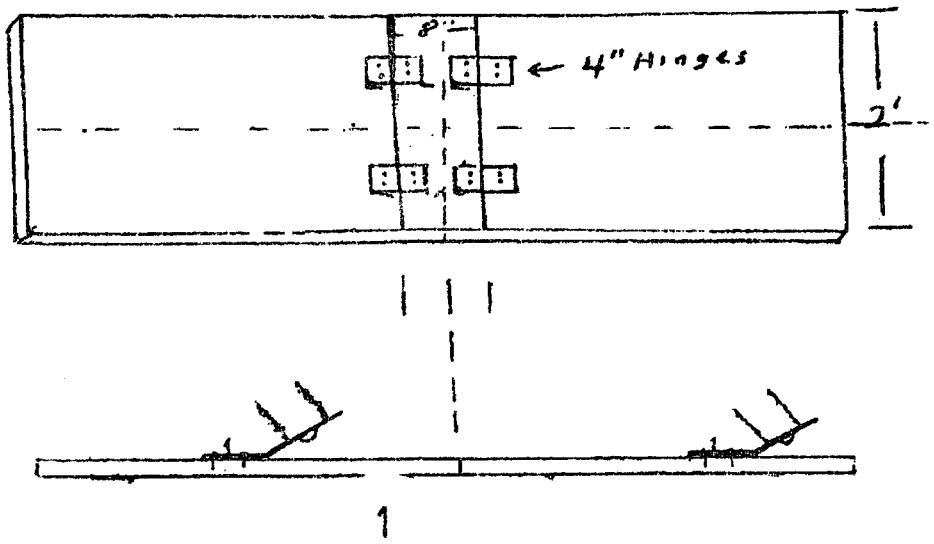
FIG. 9 is a view of the base plates on a folding deployment board.

The snare operates to harness the control arms and drive axles of the wheels of the vehicle (V), while piercing the tires (T) with barbs (1), in order to disable the vehicle (V). The snare consists of a folding deployment board (4) with a hinge (H) in the middle, as shown in FIGS. 2 and 9. A 30-foot long and 0.5-inch diameter wire rope or cable (3) is removably fastened onto the deployment board by a plurality of clips, in a configuration having two loops in order to engage each tire (T). The removable connection allows the cable (3) to separate from the deployment board (4) when struck by a moving vehicle (V). The wire rope (3) is threaded through a plurality of steel base plates (2), preferably ⅛ inch thick, by drawing the rope (3) through a guide tube (7) that is welded to the lower surface of each plate (2) as shown in FIGS. 1, 4, and 7. A wire rope or cable (3) is preferred to using a chain. Each steel base plate (2) is equipped with four or five barbs (1) in a screw-type configuration that are mounted on a swivel collar to aid the turning of the barb (1) into the solid rubber of the tire (T). As the tires (T) of a vehicle (V) approach plates (2) as shown in FIG. 3, the angle of the barbs (1) facilitate direct piercing into the tires (T) while the cable (3) surrounds the tires (T). The cable (3) is fashioned with a sliding noose, as shown in FIGS. 4, 5, 6, 8, and 9. The base plates (2) with the barbs (1) are forced into the tire (T) of the moving vehicle (V) causing the cable (3) to wrap around the control arms and drive axles of the wheels, as illustrated in FIGS. 5 and 6. This action of using the vehicle's own power generated by the spinning tires (T) creates a lasso-effect, causing the noose to tighten as shown in FIG. 5, thereby disabling the vehicle's control arms and drive axles and causing the wheels to seize.

I claim:

1. An apparatus for engaging wheels of a moving vehicle and stopping the vehicle, the vehicle having tires with control arms and drive axles, the apparatus comprising:

a 10 foot long and 1 to 2 foot wide deployment board having a hinge in a central portion, a 30 foot long, 0.5 inch diameter wire rope removably fastened onto said deployment board by a plurality of clips for allowing said wire rope to separate from said deployment board when struck by said moving vehicle, said wire rope attached to a plurality of 4 inch by 8 inch by ⅛ inch steel plates, each said plate having an upper surface and a lower surface, a guide tube welded onto the lower surface of each said plate, said wire rope threaded through each guide tube on each plate for maintaining said wire rope in connection with said plates, a plurality of barbs welded onto the upper surface of each said plate, said wire rope configured into a shape of two sliding loops on said deployment board, one loop for each wheel of the vehicle, whereby each loop engages a tire, creating a lasso effect, and forcing said plurality of barbs on said plates into the tires of the vehicle, causing the cable to wrap around the wheel and control arms, thereby using the vehicle's own power to generate the lasso effect to disable the vehicle's control arms and drive axles, and causing the wheels to seize and/or deflate.

2. A method of engaging wheels of a moving vehicle and stopping the vehicle, the vehicle having tires with control arms and drive axles, the method comprising:

providing a plurality of 4 inch by 8 inch by ⅛ inch steel plates, said steel plates each having an upper surface and a lower surface, mounting a plurality of barbs onto the upper surface of each said plate, attaching a guide tube to the lower surface of each plate by welding, threading a 0.5 inch diameter and 30 foot long wire rope through each of said guide tubes, placing said wire rope having a plurality of said steel plates thereon onto a 10 foot long and 1 to 2 foot wide deployment board having a hinge in a central portion thereof, laying said wire rope on said deployment board in a configuration having two sliding loops, one loop to engage each wheel, and removably fastening said wire rope onto said deployment board by a plurality of clips, and placing said deployment board with attached said wire rope on a ground surface in front of a moving vehicle, whereby each said loop engages a wheel of the vehicle, creating a lasso effect, forcing said plurality of barbs on the plates into the tires of the vehicle and causing said wire rope to wrap around the wheel and control arms, thereby using the vehicle's power to generate the lasso effect to disable the control arms and the drive axles of the vehicle, and causing the wheels to seize and/or deflate.

* * * * *